United States Patent [19]

Nied

[11] Patent Number: 4,602,743

[45] Date of Patent: Jul. 29, 1986

[54] FLUIDIZED BED JET MILL

[75] Inventor: Roland Nied, Bonstetten, Fed. Rep. of Germany

[73] Assignee: Alpine Aktiengesellschaft, Augsburg, Fed. Rep. of Germany

[21] Appl. No.: 662,815

[22] Filed: Oct. 19, 1984

[30] Foreign Application Priority Data

Oct. 20, 1983 [DE] Fed. Rep. of Germany ..... 3338138

[51] Int. Cl.[4] ..... B02C 19/06

[52] U.S. Cl. ..... 241/5; 241/39

[58] Field of Search ..... 241/1, 5, 39, 18, 40

[56] References Cited

U.S. PATENT DOCUMENTS

| | | | |
|---|---|---|---|
| 1,948,609 | 2/1934 | Andrews et al. | 241/5 |
| 3,186,648 | 6/1965 | Mandle et al. | 241/5 X |
| 3,734,413 | 5/1973 | Kaiser | 241/39 |
| 4,424,199 | 1/1984 | Iya | 241/5 X |
| 4,553,704 | 11/1985 | Wilson et al. | 241/5 X |

*Primary Examiner*—Mark Rosenbaum

*Attorney, Agent, or Firm*—Pennie & Edmonds

[57] ABSTRACT

The apparatus disclosed relates to a fluidized bed jet mill having a grinding chamber which is free of fixtures which is provided in its bottom region with a nozzle with a gas jet emerging vertically upward. The jet mill is configured such that when the grinding chamber is filled with the material to be reduced in size, material and gas emerge from the bed of material as a column of little speed. The column serves as a feeder for a classifier provided above the surface of the material bed and driven independently from the impulse of the jet emerging from the bottom nozzle. For improving the efficiency of energy utilization in grinding, a plurality of additional nozzles are provided. The additional nozzles discharge below the surface of the bed of material and into the grinding chamber. The orifices of the additional nozzles are uniformly distributed in a plane running perpendicular to the axis of the bottom nozzle. The additional nozzles are distributed about the circumference of a circle within the plane and coaxial with the axis of the bottom nozzle. The axes of the additional nozzles all intersect at a point on the axis of the bottom nozzle below the plane of the nozzle orifices.

12 Claims, 2 Drawing Figures

FLUIDIZED BED JET MILL

BACKGROUND OF THE INVENTION

1. Field of the Invention

The present invention relates to jet mills and, in particular, to fluidized bed jet mills in which the material to be comminuted is fed into a gas jet of high velocity wherein such material is disintegrated by interparticle impact.

2. Description of the Prior Art

Jet mills despite their high consumption of specific energy continue to represent economically operated size-reduction machinery. This is especially true in applications where there exists requirements of high purity or a high degree of fineness in the ground products. Also, in applications where wear and deposit formations are to be expected, plants with size-reduction machinery which has moving grinding tools become fairly complicated and rather costly in installation and operation.

The fluidized bed jet mill, particularly meets these requirements. Because of ensuing a high load of the jet with material, the fluidized bed jet mill has an efficiency two to four times greater than that of other known jet mills (e.g., the spiral jet mill) and even with the hardest grinding stock it operates practically without wear.

However, because of increasing energy costs it is essential to seek measures to reduce the consumption of specific energy by the grinding process (i.e., increase efficiency). This is the object of the present invention in connection with known fluidized bed jet mills.

SUMMARY OF THE INVENTION

The above-mentioned objective is accomplished using the apparatus of the present invention. The apparatus uses a given plurality, for example, three, four or five jet nozzles in addition to the vertical jet nozzle shown in the prior art. These additional nozzles are provided below the surface of the bed of the material found in the grinding chamber of the fluidized bed jet mill, and discharge into the latter. The nozzle orifices are uniformly distributed along the circumference of a circle. The circle is centered around the axis of the bottom (vertical) nozzle and is in a plane perpendicular to that axis. The axes of the additional nozzles intersect at a point on the axis of the bottom (vertical) nozzle, below the plane of the additional nozzle orifices.

With this nozzle arrangement the bed of material is subjected to very intensive churning motion which effects the entire contents of the grinding chamber. This causes the jets to be more highly loaded with material which means better utilization of energy with correspondingly improved grinding efficiency. In addition, this effectively prevents settling and consolidation of portions of the bed of material observed in known fluidized bed jet mills. When present, settling and consolidation impair the grinding action and make cleaning of the grinding chamber more difficult.

Further, it has been found that the optimal grinding effect of the arrangement pursuant to the invention is obtained when the point of intersection of the nozzles axes is positioned at a distance from the plane of the nozzle orifices such that, mathematically, the vectorial sum (i.e., that obtained by geometric addition) of the impulse flows of all nozzles becomes zero. In this connection, impulse flow of a nozzle is to be understood as the product of jet velocity at the nozzle orifice and the quantity of gas passing through it per unit time; impulse flow corresponds to the impulse referred to the unit of time, of the gas jet emerging from the nozzle and has the dimension of a force.

It is also advantageous if all nozzles are designed alike and have like dimensions. Like distances from the nozzle orifices to the focus of the jets is thereby produced for all nozzles. This causes like grinding conditions to prevail for each jet. In this way the space requirement of the nozzle arrangement is reduced to a minimum. This allows a smaller grinding chamber load which results in further improvements in the utilization of energy.

BRIEF DESCRIPTION OF THE DRAWINGS

Although several embodiments of the invention are possible, one embodiment is presented in the following drawings by way of example.

DESCRIPTION OF THE PREFERRED EMBODIMENT

Figure 1:
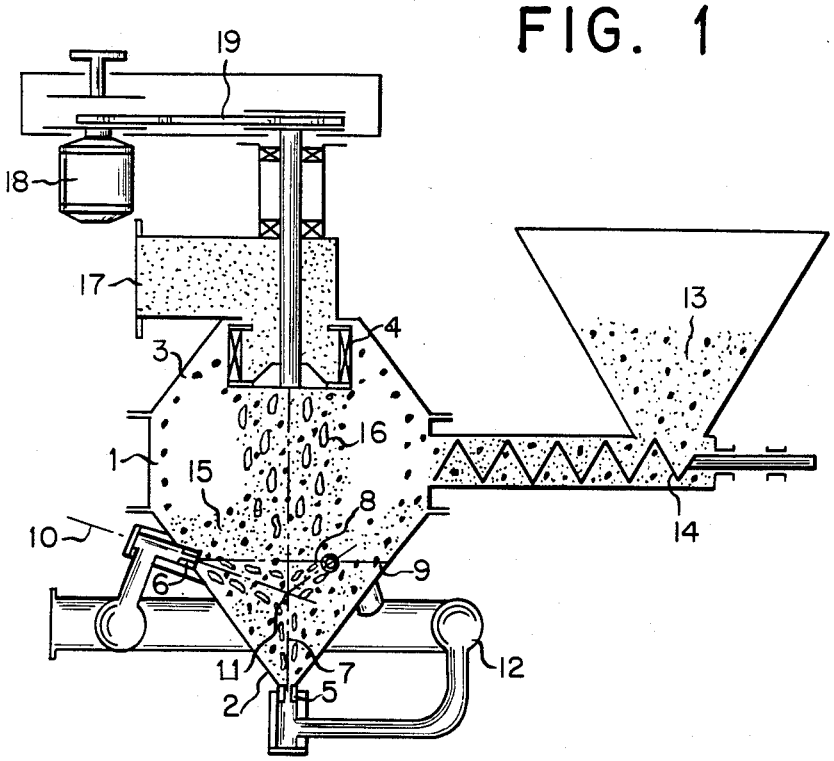
FIG. 1 is a sectional view of the apparatus of the invention.
Figure 2:
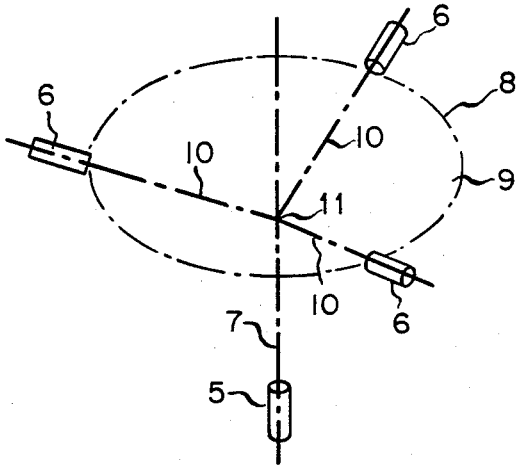
FIG. 2 is a geometric schematic showing the relative positions of the jet nozzles and their axes.

One embodiment of the invention is represented in the drawing. The jet mill illustrated in FIG. 1 has a grinding chamber 1, free of built-in equipment for grinding purposes e.g., injectors or baffle plates, which is designed in its lower region as a cone 2. Toward the top, the grinding chamber 1 is closed off by the classifier or sifter 3 with classifier wheel 4. The nozzles 5, 6 discharge into the grinding chamber 1. The bottom nozzle 5 discharges with its gas jet emerging vertically upward. The three additional nozzles 6 have orifices uniformly distributed about the circumference of a circle 8 which is coaxial to the axis 7 of the bottom nozzle 5 and lies in a plane 9 running perpendicular to the axis 7. The axes 10 of the additional nozzles 6 intersect at point 11 on the axis 7 and below the plane 9 as shown in FIG. 2. Bottom nozzle 5 and additional nozzles 6 are designed alike and have like dimensions. This is done so that the distance between the nozzle orifice and point 11 is equal for all the nozzles 5 and 6. The distance of point 11 from plane 9 is selected such that, mathematically, the vectorial sum of the impulse flows of the nozzles 5 and 6 becomes zero. In this embodiment it is one-quarter of the distance of the orifice of the bottom nozzle 5 from the plane 9. This occurs because in this embodiment all nozzles 5 and 6 are fed from the common supply line 12 and therefore jet speed at the nozzle orifice and quantity of gas passing through per unit of time are alike for all nozzles 5 and 6.

The material 13 to be reduced in size is conveyed into the grinding chamber 1 by means of a metering screw 14 which is adjustable for speed. Upon entering the grinding chamber 1 the material 13 forms a material bed 15. The material bed 15 is of sufficient height that the material and gas (from nozzles 5 and 6) are transported upward to the classifier wheel 4 at low speed forming a column 16. The fine material of the classifier leaves the jet mill by way of discharge line 17. Discharge line 17 leads to a dust precipitator (not shown), for example a cyclone or filter or both. The coarse classifier material circulates downward along the wall of the grinding chamber 1 and returns to the bed of material 15. The fineness of the finished material is adjusted by way of the speed of the classifier wheel 4, which is driven by motor 18 via a belt drive 19 with an infinitely adjustable speed ratio.

What is claimed is:

1. A fluidized bed jet mill comprising:

a grinding chamber containing a bed of particulate material which is to be reduced in size, said chamber being substantially free of internal components in the location of the bed of particulate material;

upwardly directed nozzle means for delivering a high velocity jet of gaseous medium in a substantially vertical direction, said upwardly directed nozzle means located in the lower portion of the grinding chamber below the bed of particulate material; and a plurality of inwardly directed nozzle means for delivering high velocity jets of gaseous medium in an inwardly and downwardly direction; said plurality of inwardly directed nozzle means located in a plane substantially perpendicular to the axis of said upwardly directed nozzle means; said plane being located below the top of the bed of particulate material; the axes of said plurality of inwardly directing nozzle means intersecting at a point on the axis of the upwardly directed bottom nozzle which is below the plane of the plurality of inwardly directed nozzle means.

2. The fluidized bed jet mill of claim 1 wherein the point of intersection of the nozzle means axes is located at a distance from the plane for which, mathematically, the vectorial sum of impulse flows from all nozzle means is zero.

3. The fluidized bed jet mill of claim 1 wherein the upwardly directed nozzle means is completely filled with particulate material such that the particulate material and gaseous medium emerge from said nozzle means as an upwardly moving column having a low speed.

4. The fluidized bed jet mill of claim 3 further comprising classifier means located above the top of the bed of particulate material for removal of particulate material of a predetermined reduced particle size, and wherein the upwardly moving column flows to said classifier means.

5. The fluidized bed jet mill of claim 1 wherein the bottom portion of the grinding chamber has a conical configuration, the diameter of which increases along the vertical distance from the upwardly directed nozzle means.

6. The fluidized bed jet mill of claim 1 further comprising means for supplying particulate material to the grinding chamber, said supplying means located adjacent to and in communication with said grinding chamber.

7. The fluidized bed jet mill of claim 1 wherein the plurality of inwardly directed nozzle means are uniformly designed and have like dimensions.

8. A fluidized bed jet mill comprising:

a grinding chamber containing a bed of particulate material which is to be reduced in size, said chamber being substantially free of internal components in the location of the bed of particulate material;

classifier means located within the grinding chamber but above the bed of particulate material for removal of particulate material of a predetermined reduced particle size;

means for supplying particulate material to the grinding chamber, said supplying means located adjacent to and in communication with the grinding chamber;

upwardly directed nozzle means for delivering a high velocity jet of gaseous medium in a substantially vertical direction, said upwardly directed nozzle means located in the lower portion of the grinding chamber below the bed of particulate material; and a plurality of inwardly directed nozzle means for delivering a high velocity jets of gaseous medium in an inwardly and downwardly direction; said plurality of inwardly directed nozzle means located in a plane substantially perpendicular to the axis of said upwardly directed nozzle means; said plane being located below the top of the bed of particulate material; the axes of said plurality of inwardly directing nozzle means intersecting at a point on the axis of the upwardly directed bottom nozzle which is below the plane of the plurality of inwardly directed nozzle means; wherein the upwardly directed nozzle means is completely filled with particulate material such that the particulate material and gaseous medium emerge from said nozzle means as an upwardly moving column having a low speed; said column flowing to and contacting said classifier means.

9. A method for reducing the size of particulate matter in a fluidized bed jet mill which comprises:

constructing a fluidized bed jet mill which comprises a grinding chamber substantially free of internal components in the area where a bed of particulate material is to be maintained for size reduction; upwardly directed nozzle means located at the bottom of said grinding chamber below said bed of particulate matter; a plurality of inwardly directed nozzle means located in a plane substantially perpendicular to the axis of said upwardly directed nozzle means, the axes of said plurality of nozzle means intersecting at a point on the axis of the upwardly directed bottom nozzle means which is below the plane of the plurality of nozzle means; and classifier means located above the top of the particulate bed for removing particulate material of a predetermined reduced particle size;

supplying the grinding chamber with a bed of particulate material, said particulate matter also filling the upwardly directed nozzle means;

delivering a high velocity jet of gaseous medium to said bed through said upwardly directed nozzle means in a substantially vertical direction, said gaseous medium and particulate matter emerging from said nozzle means as an upwardly directed, slow moving column which flows to and contacts said classifier means;

delivering additional high velocity jets of gaseous medium from said plurality of inwardly directed nozzle means in an inwardly and downwardly direction to said intersection point of the axes of the nozzle means;

generating an intensive churning motion from the delivery of said additional jets of gaseous medium to cause the particulate material to impinge upon itself and be reduced in size as well as to prevent settling or consolidation of the bed, thereby increasing the grinding efficiency and reducing the corresponding energy utilization for the mill; and removing particulate material of a predetermined reduced particle size by said classifier means.

10. The method of claim 9 which further comprises constructing the bottom portion of said grinding chamber in a conical configuration, the diameter of which increases along a vertical distance from the upwardly directed nozzle means.

11. The method of claim 9 which further comprises providing the jet mill with particulate material supply means located adjacent to and in communication with said grinding chamber.

12. The method of claim 9 which further comprises selecting the intersection point of the axes of all nozzle means at a point where the vectorial sum of impulse flows from all nozzle means is zero.

* * * * *